US005331751A

United States Patent [19]

Harwood

[11] Patent Number: 5,331,751

[45] Date of Patent: * Jul. 26, 1994

[54] MOLDED PLASTIC TOE CAP

[76] Inventor: John M. Harwood, 15140 Irene Ct., Elm Grove, Wis. 53122

[ * ] Notice: The portion of the term of this patent subsequent to May 18, 2010 has been disclaimed.

[21] Appl. No.: 63,285

[22] Filed: May 18, 1993

Related U.S. Application Data

[63] Continuation-in-part of Ser. No. 798,387, Nov. 26, 1991, Pat. No. 5,210,963.

[51] Int. Cl.[5] ..... A3C 13/14

[52] U.S. Cl. ..... 36/77 R; 36/77 M; 36/72 R

[58] Field of Search ..... 36/77 R, 77 M, 72 R; 12/146 D

[56] References Cited

U.S. PATENT DOCUMENTS

| | | | |
|---|---|---|---|
| 3,950,865 | 4/1976 | Gray | 36/77 R |
| 4,735,003 | 4/1988 | Dykeman | 36/77 R |
| 5,210,963 | 5/1993 | Harwood | 36/77 R |

FOREIGN PATENT DOCUMENTS

| | | | |
|---|---|---|---|
| 0100181 | 11/1983 | European Pat. Off. | 36/77 R |
| 0095061 | 2/1984 | European Pat. Off. | 36/77 R |
| 2071989 | 9/1981 | United Kingdom | 36/77 R |
| 2127275 | 4/1984 | United Kingdom | 36/72 R |
| 2138272 | 10/1984 | United Kingdom | 36/72 R |

*Primary Examiner*—Paul T. Sewell
*Assistant Examiner*—Marie Denise Patterson
*Attorney, Agent, or Firm*—Andrus, Sceales, Starke & Sawall

[57] ABSTRACT

A toe cap for a protective shoe is injection molded utilizing a fiber-filled plastic resin having a high loading of relatively long fibers. A preferred material is glass-filled polyurethane having fibers predominantly of a length in the range of 0.25 inch (6 mm) and 1 inch (25 mm). The resin injection gate is positioned to provide injection of the fiber-filled plastic material directly adjacent the rear edge of the toe cap, preferably between the roof of the cap and the lower edge of one wall. The gate has a minimum dimension of 0.100 inch (2.5 mm). The gate location and size results in a lateral orientation of the fibers in the injected plastic material across the roof of the toe cap to substantially enhance the strength thereof.

9 Claims, 2 Drawing Sheets

FIG. 1
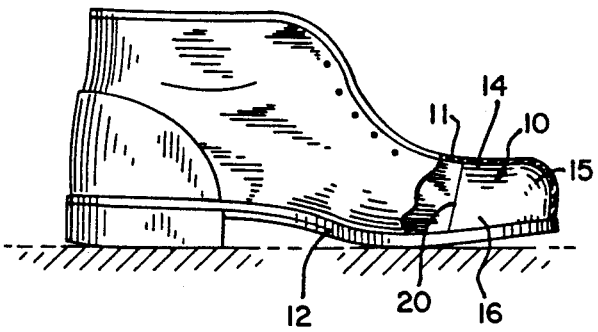
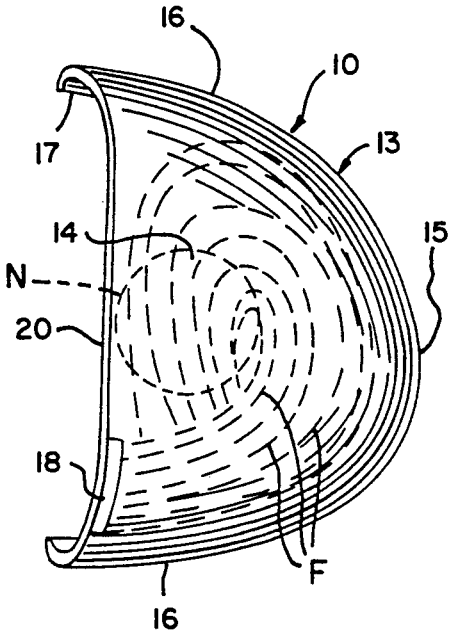
FIG. 2
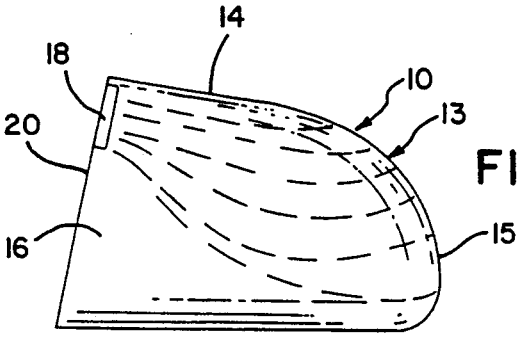
FIG. 3
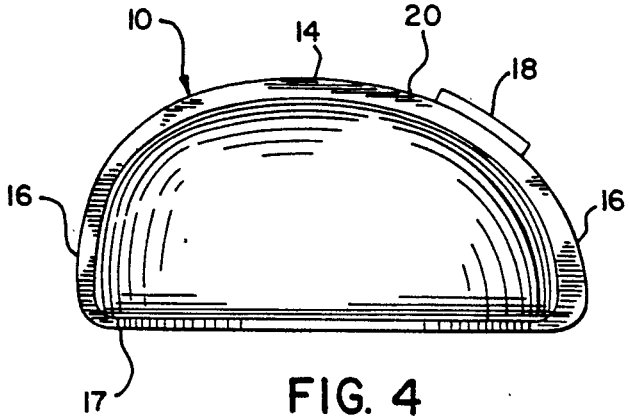
FIG. 4

MOLDED PLASTIC TOE CAP

This application is a continuation-in-part of Ser. No. 07/798,387, filed Nov. 26, 1991, now U.S. Pat. No. 5,210,963.

BACKGROUND OF THE INVENTION

The present invention relates to a toe cap for a protective shoe and, more particularly, to a reinforced, injection molded plastic toe cap.

For many years, toe caps for protective shoes have been made of thin steel sheets formed into shoe toe-shaped bodies which are sewn or otherwise attached on the inside of the leather toe cap of a shoe or boot. Steel toe caps are known to deform under vertically applied compressive or impact loads and to undertake a permanent set which, if excessive, may result in a crushing and/or cutting injury to the toes of the wearer. Attempts have been made more recently to substitute various plastic materials for steel in safety toe caps and number of prior art patents show such constructions.

One of the more relevant prior art patents is Dykeman U.S. Pat. No. 4,735,003 which describes a molded plastic toe cap made of a variety of thermoplastic and thermosetting resins, both with and without fiber reinforcement. The body of the toe cap is provided with a flexible roof region, the deflection of which under load is intended to shift stresses to the lateral and forward wall regions which are generally heavier and more capable of supporting the loads. U.S. Pat. No. 4,735,003 describes the use of a number of possible molding techniques including injection molding. Also disclosed is the use of a polyurethane plastic with glass fiber reinforcement wherein the fibers have a length in the range of ¼ inch to 1 inch as received from the plasticizing equipment and placed in a compression mold.

British Patent Application No. 2,138,272A also discloses a protective toe cap made from an injection molded glass-filled plastic material. The specification suggests that the flow rate of the plastic material and the gate size and location be chosen to ensure that there is no molding discontinuity or weakness in the upper portion of the toe cap. However, no injection flow rate nor gate size or location is specified.

European Patent Application No. 83304046.2 describes a protective toe cap for a shoe which is molded from a plastic material that is reinforced with uniaxially aligned continuous fibers extending laterally across the roof of the cap. However, the toe cap is molded using compression molding techniques and recognizes the need to carefully orient and hold the continuous fibers so that they are not dislodged from their position during molding. Injection molding techniques would not be suitable for the manufacture of this toe cap.

In the United States, suitability of toe caps for new protective footwear is determined in accordance with American National Standard for Personal—Protection Protective Footwear (ANSI Z41-1991). This Standard provides, inter alia, for separate compression and impact tests, both of which apply vertical loads to the roof of the toe cap actually installed in a shoe or boot. Similar but somewhat more rigorous standards are applicable in Canada under Canadian Standards Association toe impact test Z-195 March 1984. In Europe, the test regimen is dictated by DIN standards.

The rigorous test regimens to which protective toe caps are subject has it made extremely difficult to design and build a toe cap of either steel or plastic which will consistently meet any one of the standards, much less all of them. The problem is exacerbated by variations in toe cap styles in the United States and between the United States, Canada and Europe. These styles are, in turn, dictated to some extent by variations in the styles and in the construction of shoes, both work shoes and dress shoes which are modified to include protective toe caps. There is also a desire in the industry to eliminate steel toe caps for reasons in addition to those mentioned above, such as the heat and electrically conductive properties of steel. Also, the response of steel to magnetic or electrical signals makes it undesirable for certain military and the like applications.

Thus, there is a continuing real need in the industry for a plastic toe cap to replace steel toe caps which will meet the applicable test standards and still meet the aesthetic requirements of style, shape and relatively light weight. In addition, molded plastic toe caps should desirably be capable of being made at high production rates, such as by injection molding. It is known, however, that prior injection molding techniques and materials using fiber-reinforced plastics are subject to fiber degradation and difficulty in fiber orientation necessary to optimize the strength of the final product.

SUMMARY OF THE INVENTION

In accordance with the present invention, the toe cap for a protective shoe is injection molded from a fiber-filled plastic resin in a manner to form a toe cap having a body of conventional shape in which the strength of the roof portion is enhanced relative to at least one of the side and front walls to provide a controlled vertical collapse of the roof under a vertical load thereon. Preferably, the reinforcing fibers are optimally oriented to maximize the resistance to failure under a conventionally applied vertical load. In addition, the toe cap walls may be provided with regions of reduced cross section relative to the thickness of the roof which provide controlled collapse and failure under excessive loads in a manner providing further protection to the toes of the wearer.

It has been found that, in order to maximize the length of the glass fibers preferably used in the fiber-filled plastic resin in order to enhance the strength, the size of the gate opening into the mold must be carefully controlled in order to reduce fiber length degradation and to allow a fiber flow pattern during injection which preferentially orients the fibers in a direction laterally across the roof of the cap.

The toe cap of the present invention may be molded to any conventional style and shape of toe cap which includes a rearwardly opening shoe toe-shaped body having a roof which blends smoothly in curved transition regions into opposite lateral generally vertical side walls and a generally vertical front wall to define a conventional toe cap body. The body is made of a fiber-filled plastic resin having a major amount of the fibers in the resin which forms the roof of the body oriented in a lateral direction between the side walls.

The rear edge is also the preferred location of the gate for admitting the molten plastic resin for making the toe cap by an injection molding process. Preferably, the gate opening is directly adjacent the rear edge of the body and along the transition region between the roof and one of the side walls. However, if the minimum dimension of the gate to the mold is carefully controlled, suitable orientation of the fibers can be attained with an injection point anywhere along the rear edge. It has been found that a gate inlet to the mold cavity having a minimum dimension of 0.100 inch prevents any significant reduction in the length of injected fibers which are preferably predominantly in the range of 0.25 inch to 1 inch.

The use of a fiber-filled plastic resin and the preferred location and size of the injection molding gate allows the fibers in the injected plastic resin to orient in the generally lateral direction across the roof of the body. The fiber-filled plastic resin preferably comprises a glass fiber-filled polyurethane. The glass fibers are preferably predominantly of a length greater than 0.25 inch, but not greater than 1.0 inch and, more preferably, predominantly of a length of at least 0.5 inch. The glass fibers are preferably supplied in the range of about 50% to 65% by weight of the fiber-resin mixture.

BRIEF DESCRIPTION OF THE DRAWINGS

FIG. 1 is a side elevation, partly cut away, showing the installation of a toe cap of the present invention in a work shoe.

FIG. 2 is a top plan view of the presently preferred embodiment of the toe cap of the present invention showing in phantom lines the orientation of the reinforcing fibers in the filter-filled resin from which the toe cap is injection molded.

FIG. 3 is a side elevation of the toe cap shown in FIG. 2.

FIG. 4 is a rear elevation of the toe cap shown in FIGS. 2 and 3.

DETAILED DESCRIPTION OF THE PREFERRED EMBODIMENTS

Figure 5:
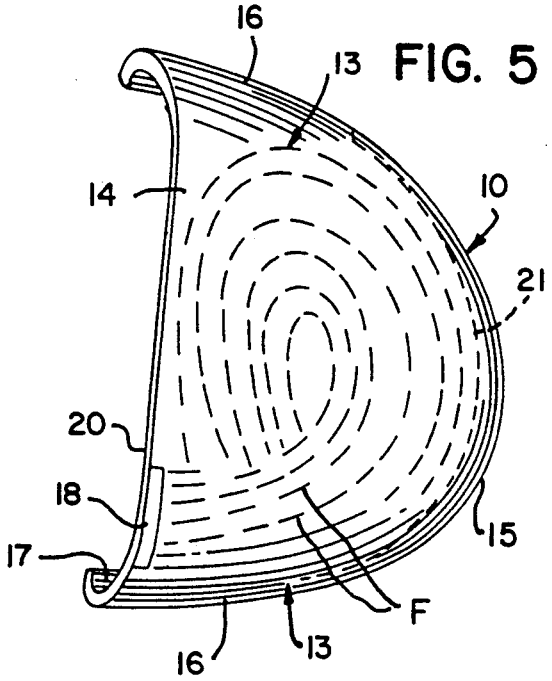
FIG. 5 is a top plan view of a toe cap showing an alternate embodiment of the invention.

In FIG. 1, there is shown a conventional work shoe having installed therein a toe cab 10 of the present invention. In accordance with conventional shoe industry practice, the toe cap 10 is installed during manufacture of the shoe by placing the same over an inner liner and last (neither shown) and enclosing the toe cap in the shoe upper 11 which is subsequently attached to the shoe sole 12 in a conventional manner. Whether formed of sheet steel, molded of plastic, or made of some other material, toe caps all have a generally similar shape, although a number of different styles are utilized to accommodate varying shoe toe styles. In any event, the toe cap 10 is of generally the same shape as the upper toe portion of the shoe for which it is made.

Referring also to FIGS. 2–4, the toe cap 10 of the present invention comprises a unitary shoe toe-shaped body 13, including an upper roof 14 which slopes forwardly and laterally in a smooth continuous surface to blend into a front wall 15 and opposite lateral side walls 16. The toe cap body 13 is asymmetrical as is well known in the art. The front wall 15 and side walls 16 are generally vertical, however, they may be substantially curved over their entire extent, both vertically and horizontally, as shown. The side walls and front wall blend together to form a continuous outer wall and, in the embodiments shown, the continuous outer wall includes an integral inwardly turned narrow lip 17 along the entire lower edge of the body. The lip may be desirable to facilitate installation of the toe cap in the shoe, all in a manner well known in the art.

In accordance with the preferred embodiment of the invention, the toe cap 10 is injection molded using a plastic resin material having a high loading of reinforcing fibers. The toe cap is molded in a manner to preferentially orient the reinforcing fibers in the resin material which forms the roof 14 in a generally lateral direction between the opposite side walls 16. Referring particularly to FIG. 2, the preferred orientation of the reinforcing fibers F is shown schematically in phantom lines. It is believed that the preferred fiber orientation is uniquely attainable by proper sizing and location of the gate 18 (shown relative to the toe cap body itself) in the injection mold by which the toe caps are preferentially molded. By positioning the gate 18 on the rear edge 20 of the toe cap body, preferably in the area of the curved transition between the roof 14 and the lower edge of one side wall 16, and by further widening the gate to spread the entry point for the fiber filled resin in a lateral direction and also assuring that the gate width in the longitudinal direction is adequate, the preferential orientation of fibers F in the roof 14 is attained. In my prior patent, identified above, the position of the gate 18 specifically in the transition between the roof 14 and one of the side walls 16 was believed to be important to attain the preferential lateral orientation of the fibers F across the roof 14. It has since been discovered that by restricting the width of the gate in the longitudinal direction of the toe cap 10, not only is fiber movement and proper fiber orientation inhibited, but too narrow a gate opening also results in fiber length degradation so that the initially longer fiber lengths in the plastic resin are broken into shorter lengths as they pass through the narrow gate opening. A fiber-filled plastic resin material which has been found to work well is a glass-filled polyurethane blend supplied by Polymer Composites Incorporated. The nominal 60% by weight filling of glass fibers in this material preferably contains fiber lengths in the range of 0.25 inch to 1 inch (approximately 6 mm to 25 mm). The minimum gate dimension, in this embodiment the gate width in the longitudinal direction, is 0.100 inch (approximately 2.5 mm). The gate should have a length of at least 0.250 inch (approximately 6 mm). The best results have been attained with a gate size having a length of 0.750 inch (approximately 19 mm) and a width of 0.190 inch (approximately 5 mm). Apart from the preferred orientation of the fibers F in the roof 14, fiber orientation elsewhere in the toe cap is not believed to be particularly important.

If the width of the gate 18 is reduced below the minimum dimension of 0.100 inch (2.5 mm), some of the injected fiber-filled plastic material tends to short circuit or flow directly across the roof 14 in a direction counter to the preferred flow and orientation of the fibers F shown in FIG. 2. Where the counter flow meets the preferred generally circular flow, a discontinuity or fault line occurs directly in the region of the roof 14 where a vertical drop load would typically be imposed. This discontinuity is likely to result in toe cap test failure. As shown in FIG. 2 and in accordance with the ANSI test standard identified above, a 50 pound (22.7 kg) load is attached to a flat one inch (25.4 mm) diameter nose N which is dropped onto the roof 14 from a height of approximately 18 inches (45.7 cm) or a height sufficient to provide an impact velocity of 118 inches per second (approximately 3 m/sec).

Figure 6:
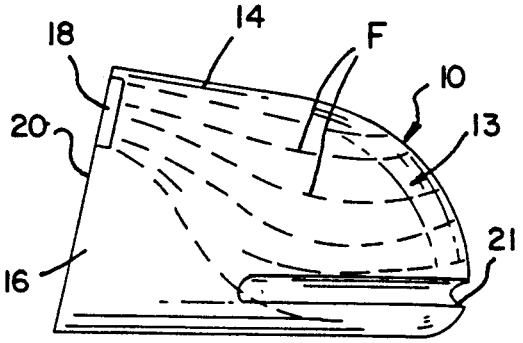
FIG. 6 is a side elevation of the toe cap shown in FIG. 5.

Referring also to FIGS. 5 and 6, the toe cap of the present invention may include a region of substantially reduced cross section in the front wall 15 specifically comprising an elongate generally horizontal slot 21 extending along the entire front wall 15 and rearwardly along and into portions of both side walls 16 as discussed in greater detail in my previously identified patent. The slot 21 may be formed in any convenient manner, but is most conveniently formed in an injection molded part with a simple mold insert. If the size of the gate 18 is selected to be similar to that described above with respect to the embodiment of FIGS. 2–4, the fiber flow and orientation will also be similar as shown in FIGS. 5 and 6. Thus, the inclusion of the horizontal slot 21 has no significant effect on fiber flow and ultimate fiber orientation in the toe cap.

Figure 7:
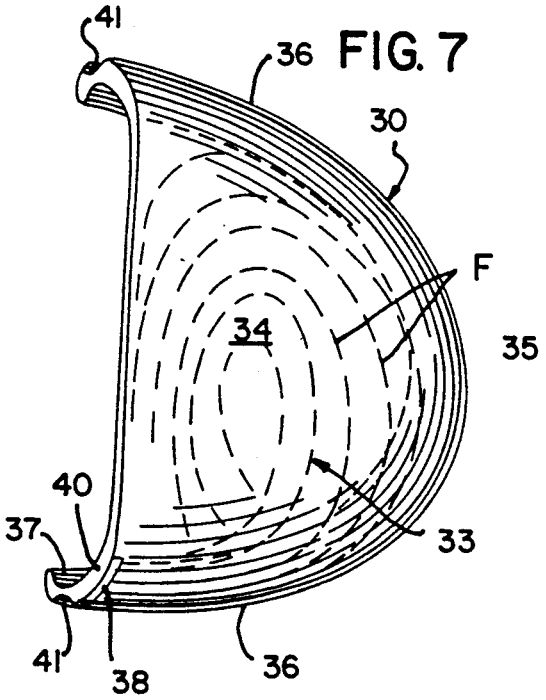
FIGS. 7 and 8 are views similar to FIGS. 5 and 6 showing a further embodiment of the invention.
Figure 8:
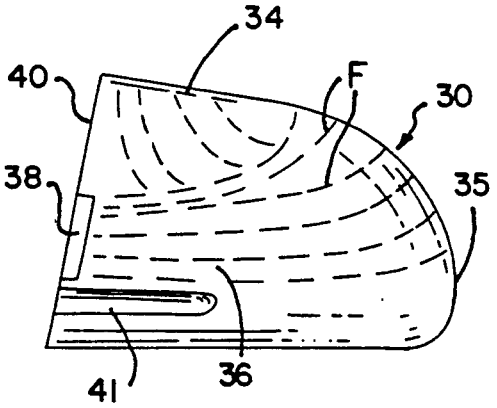

In lieu of the forwardly positioned slot 21 of the embodiment of FIGS. 5 and 6, the alternate embodiment shown in FIGS. 7 and 8 includes a toe cap 30 having a slot 41 in each of the side walls 36 extending forwardly from the rear edge 40 of the body 33 toward the front wall 35. The slots 41 may be of any convenient shape to provide the regions of reduced cross section along the lower edges of the side walls 36 as shown. In this embodiment, a gate 38 is positioned further down one side wall 36, substantially closer to the lower edge 37, but above the position of formation of the slot 41. The gate 38 has the same preferred length and width described above with respect to the embodiments of FIGS. 2–6. With the proper gate sizing, the fiber flow and orientation follows a pattern similar to that shown in the prior embodiments, as may be seen with reference to the lines F in FIGS. 7 and 8. In particular, the generally circular flow and orientation of the fibers results in a major amount of the fibers in the resin portion which forms the roof 34 to be oriented in a generally lateral direction between the side walls 36.

Various modes of carrying out the present invention are contemplated as being within the scope of the following claims particularly pointing out and distinctly claiming the subject matter which is regarded as the invention.

I claim:

1. An injection molded toe cap for a protective shoe of the type having a rearwardly opening shoe toe-shaped body including a roof which blends smoothly into opposite lateral generally vertical side walls and a generally vertical front wall, and an open rear end defined by a rear edge including the rear edges of the roof and side walls, said toe cap comprising:

a fiber-filled plastic resin body formed in a mold including a mold cavity defining the shape of the toe cap, said body having a major amount of the fibers in the resin portion forming the roof forwardly from the rear edge oriented in a generally laterally direction between the side walls; and, gate means in the mold adjacent the rear edge of the body for admitting the fiber-filled plastic resin to form the injection molded body, said gate means defining a resin inlet to the mold cavity having a minimum dimension of 0.10 inch (2.5 mm).

2. The toe cap as set forth in claim 1 wherein the fibers are of a length predominantly in the range of 0.25 inch to 1 inch.

3. The toe cap as set forth in claim 2 wherein the fiber-filled plastic resin comprises glass fiber-filled polyurethane.

4. The toe cap as set forth in claim 1 wherein said gate means is positioned generally between the roof and the lower edge of one side wall.

5. The toe cap as set forth in claim 1 wherein said gate means comprises a generally rectangular opening having a length along the rear edge not less than about 0.25 inch and width not less than about 0.10 inch.

6. A method for molding a toe cap for a protective shoe, said cap having a rearwardly opening shoe toe-shaped body including a roof which blends smoothly into opposite lateral generally vertical side walls and a generally vertical front wall, and an open rear end defined by a rear edge including the rear edges of the roof and side walls, said method comprising the steps of:

(a) preparing a mold having a cavity conforming to the shape of the toe cap; and, (b) injecting a molten fiber-filled plastic resin under pressure into the mold with a resin injection gate having a minimum dimension at the point of entering into the mold cavity of at least about 0.10 inch and in direct communication with the portion of the mold cavity defining the rear edge of the toe cap to fill the cavity and to cause a major amount of the fibers in the resin forming the roof forwardly from directly adjacent the rear edge to be oriented in a generally lateral direction between the side walls.

7. The method as set forth in claim 6 wherein the fiber-filled plastic resin comprises glass-filled polyurethane having glass fibers of a length predominantly in the range of 0.25 inch to 1 inch.

8. The method as set forth in claim 6 wherein the resin injection gate is positioned between the roof and the lower edge of one side wall.

9. The method as set forth in claim 6 wherein said gate has a length laterally along the rear edge of at least about 0.25 inch and a width of at least about 0.10 inch.

* * * * *